US005906194A

United States Patent [19]

Wedel

[11] Patent Number: 5,906,194

[45] Date of Patent: May 25, 1999

[54] SIDE EDGE ASSEMBLY FOR A COOLING GRATE

[76] Inventor: Karl Von Wedel, Gerberhof 5, Neustadt 31535, Germany

[21] Appl. No.: 08/747,162

[22] Filed: Nov. 8, 1996

[30] Foreign Application Priority Data

Nov. 10, 1995 [DE] Germany ..... 195 42 013

[51] Int. Cl.[6] ..... F23H 13/00

[52] U.S. Cl. ..... 126/152 B; 126/167; 110/281; 110/283

[58] Field of Search ..... 126/152 B, 125 A, 126/176 R, 174, 167; 110/281, 283, 291

[56] References Cited

U.S. PATENT DOCUMENTS

| | | | |
|---|---|---|---|
| 4,170,183 | 10/1979 | Cross | 110/268 |
| 4,394,118 | 7/1983 | Martin | 431/4 |
| 4,563,959 | 1/1986 | Fujiwara | 110/281 |
| 5,069,146 | 12/1991 | Dethier | 110/281 |
| 5,271,339 | 12/1993 | Yamagishi et al. | 110/281 |
| 5,433,157 | 7/1995 | Dittmann et al. | 110/289 |
| 5,549,471 | 8/1996 | Tegtmeier et al. | 432/77 |

*Primary Examiner*—Larry Jones
*Attorney, Agent, or Firm*—Flynn, Thiel, Boutell & Tanis, P.C.

[57] ABSTRACT

A side edge assembly for a cooling grate comprises a first aligned array of outer plates arranged in succession in the longitudinal direction of the grate and a second aligned array, which is between the grate and the outer plates, of inner plates arranged in succession in the longitudinal direction of the grate. In the assembled condition the joins of the outer plates and the joins of the inner plates are displaced relative to each other in the longitudinal direction.

21 Claims, 4 Drawing Sheets

SIDE EDGE ASSEMBLY FOR A COOLING GRATE

FIELD OF THE INVENTION

The present invention concerns a side edge assembly for a cooling grate.

BACKGROUND OF THE INVENTION

Cooling grates and more particularly step conveyor grates as are used for example for cooling cement clinker which is calcined in a calcining kiln are generally laterally delimited by side edge assemblies which are a component of the cooling grate and which are thus supplied by the manufacturer of the cooling grate. A typical side edge assembly comprises a plurality of edge elements which are disposed in succession in the longitudinal direction of the cooling grate, the fact that the side edge assembly is formed from edge elements permitting them to be adapted to the respective length of the associated cooling grate, as is defined by factors relating to the operating procedures involved. In an upward direction the side edge assemblies are adjoined by respective refractory brick walls of a recuperator space or chamber in which hot cooling gases, generally air, are collected. Therefore, at the level of the cooling grate, the side edge assemblies represent the lateral boundary walls defining the recuperator chamber. It will be appreciated therefore that, to achieve a good level of recuperation efficiency, it is important for leakage at the side edge assembly and the improper penetration of infiltration air at that location to be minimised.

Side edge assemblies comprising a plurality of edge or wall elements which are arranged in succession in the longitudinal direction of the cooling grate have weak points at the joins between the wall elements, where those individual wall elements meet. It is virtually inevitable that material to be cooled can escape from the cooling grate through those joins or that infiltration air can improperly penetrate into the recuperation chamber.

SUMMARY OF THE INVENTION

An object of the present invention is to provide a side edge assembly for a cooling grate, which is such as to be capable of at least reducing undesirable material leakage and improper penetration of infiltration air.

Another object of the present invention is to provide a side edge assembly for a cooling grate which can be easily assembled on site while affording improved sealing integrity in relation to leakage to the exterior of material to be cooled and improper penetration of infiltration air through the side edge assembly.

Still another object of the present invention is to provide a cooling grate side edge assembly which is of a more rational design configuration from the point of view of replacing components which are likely to wear in the course of operation of the cooling grate.

In accordance with the principles of the present invention the foregoing and other objects are achieved by a side edge assembly for a cooling grate including a first layer or aligned array of plates which are arranged in succession in the longitudinal direction of the cooling grate and which constitute outer plates. The side edge assembly further comprises a second layer or aligned array of plates which are arranged in succession in the longitudinal direction of the cooling grate and which constitute inner plates by virtue of being disposed between the outer plates and the cooling grate. In the assembled condition joins between the outer plates and joins between the inner plates are displaced relative to each other in the longitudinal direction of the cooling grate.

As will be seen from a description of preferred embodiments of the invention as set forth hereinafter the configuration according to the invention provides a kind of labyrinth sealing arrangement with a sealing path which is formed from the joins between the inner plates, the intermediate space which remains between the outer plates and the inner plates which are in closely adjoining relationship, and the joins between the outer plates. It has been found that the sealing integrity of side edge assemblies which are constructed in that way is substantially better than the previously designed side edge assemblies.

In a preferred feature of the invention the outer plates and the inner plates are in mutually overlapping relationship and are preferably connected together, for example by screw means. Although the individual inner and outer plates can each be comparatively small and light so that they are easy to handle for assembly and dismantling thereof, that design configuration still affords an extremely strong edge structure.

Another preferred feature of the invention provides that the outer plates and/or the inner plates are connected to a support structure which carries the side edge assembly. Preferably, only the outer plates are connected to the carrier structure. For mounting the side edge assembly, the outer plates are fixed to the support structure and thereafter the inner plates are connected to the outer plates, for example by screwing. That design configuration makes it possible for the inner plates to be in the form of easily replaceable wearing components which can be replaced individually or as a whole without the remainder of the edge structure having to be dismantled.

Particularly for pusher grates with reciprocable rows of grate portions, a preferred feature of the invention provides that the inner plates are made from a material which is resistant to wear and abrasion and which is adapted in the optimum manner to the operating conditions of a pusher grate; in contrast the material of the outer plates can be selected on the basis of other criteria, for example optimum strength criteria.

In another preferred feature of the invention the outer plates and the inner plates are substantially flush with each other in the assembled condition at their top edges and form a recess means for receiving a sealing means. The sealing means forms the transition from the side edge assembly to the refractory walls of the recuperator chamber so that a good level of sealing integrity is also achieved in the region of the top edge of the side edge assembly.

In order further to improve the strength interrelationship of the side edge assembly and the level of sealing integrity, in particular in the region of the joins between the plates, a preferred feature of the invention provides that the joins of the outer plates and/or the joins of the inner plates are each of a groove-and-tongue connection type.

A preferred feature of the invention provides that the inner surfaces of the outer plates and the outer surfaces of the inner plates each have a mutually complementary surface structure which ensures contact thereof over a large area. This arrangement also improves on the one hand the strength interrelationship of the side edge assembly and on the other hand the degree of sealing integrity in the region of the intermediate space between the inner plates and the outer plates.

In another preferred feature of the invention the outer plates project downwardly at least in a region-wise manner beyond the inner plates, the projecting regions projecting inwardly substantially by the thickness of the inner plates and forming a shoulder for supporting the inner plates. That arrangement serves in particular to make the assembly and mounting operation easier as the inner plates can be fitted on to the shoulders of the outer plates which have possibly already been previously connected to the above-mentioned support structure, so that the inner plates do not have to be held for the operation of screwing them to the outer plates.

For the purposes of adaptation to predetermined support structures, it may be necessary for each two successive outer plates to be of different lengths. To deal with that situation, it may be provided that the common pitch length of two outer plates corresponds to the common pitch length of two inner plates, so that the sequence of the joins of the inner plates and the outer plates is always regularly repeated.

In order to permit the inner plates to be fitted and removed from the top side of the cooling grate, a further preferred feature of the invention provides that the outer plates have through openings for bayonet-like connecting pins to be fitted thereto by passing through the openings. After the connecting pins have been fitted through the openings in the outer plates the inner plates can be fitted on to the pins and fixed by means of nuts which can be screwed on to same.

In the case of pusher grates comprising reciprocable rows of grate portions, a preferred feature of the invention provides that disposed in the region of a reciprocable row of grate portions at the inside of the inner plate is a web portion which projects substantially at a right angle from said inside of said inner plate and which extends in the direction of movement of the row of grate portions, for covering the motion gap between the row of grate portions and the side edge assembly. The web portion prevents material to be cooled from falling into the gap and also prevents an increase in frictional wear of the grate portions and/or inner plates.

In accordance with another aspect of the present invention an outer plate for a side edge assembly comprising a plurality of outer plates arranged in succession in the longitudinal direction of the side edge assembly and a plurality of inner plates arranged in succession in the longitudinal direction of the side edge assembly and bearing against the outer plates includes at a front edge a tongue means and at a rear edge a groove means for a groove-and-tongue connection to a respective outer plate arranged in front of same or behind sane, while provided at the upper edge of the outer plate is an outwardly directed crank portion for receiving a sealing means, and provided in the lower region of the outer plate is an inwardly projecting thickened portion forming an inner shoulder.

In accordance with a preferred feature of the invention, the outer plate includes in the upper wall region thereof at least one through opening for receiving a connecting pin for making a connection to an inner plate, while in the lower wall region formed by the thickened portion the outer plate may have at least one through bore for receiving a fixing pin for fixing to a support structure. The through opening for the connecting pin is preferably in the form of a slot for the passage therethrough of a bayonet head of the connecting pin while abutments for rotationally arresting a bayonet head may be provided at the outside of the through opening. The connecting pin can be fitted from the inside of the outer plate and then forms an anchor pin for fixing an inner plate, as already described above.

A further preferred configuration of the invention provides that the inside of the through opening in the outer plate is surrounded by a substantially conical centering depression co-operable with a complementary centering thickened portion on the outside of an inner plate. The centering thickened portion and the centering depression co-operable therewith make it possible for inner plates and outer plates to be laid one upon the other in accurate positional relationship, even if the person fitting the assembly does not have a good view of the assembly location.

In accordance with another aspect of the invention an inner plate for a side edge assembly comprising first and second aligned arrays of plates includes in the upper wall region thereof at least one through opening for receiving a connecting pin for making a connection to an outer plate. It will be appreciated that, when the inner plate is correctly positioned, the through opening therein is aligned with the through opening in the outer plate. In the manner already described above, the outside of the through opening is surrounded by a centering thickened portion co-operable with a complementary centering recess or depression in the outer plate while the inside of the through opening is preferably surrounded by a recess or depression for receiving a nut in flush relationship with the inside of the inner plate. That eliminates projections at the inside of the inner plate, on which the material to be cooled could become caught.

Further objects, features and advantages of the present invention will be apparent from the following description of preferred embodiments thereof.

DESCRIPTION OF PREFERRED EMBODIMENTS

Figure 1:
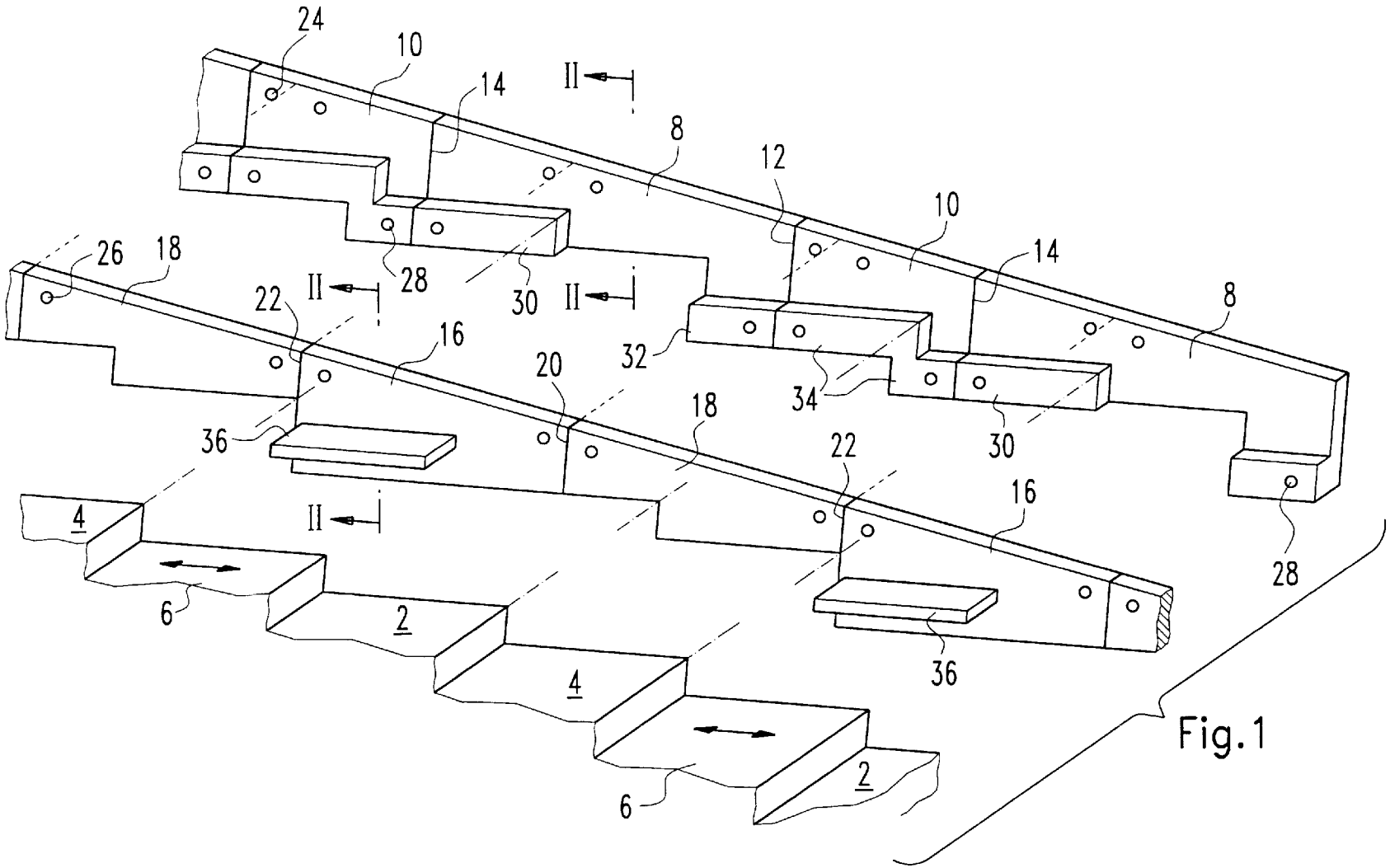
FIG. 1 is a diagrammatic perspective view of the basic structure of a side edge assembly according to the invention.
Figure 8:
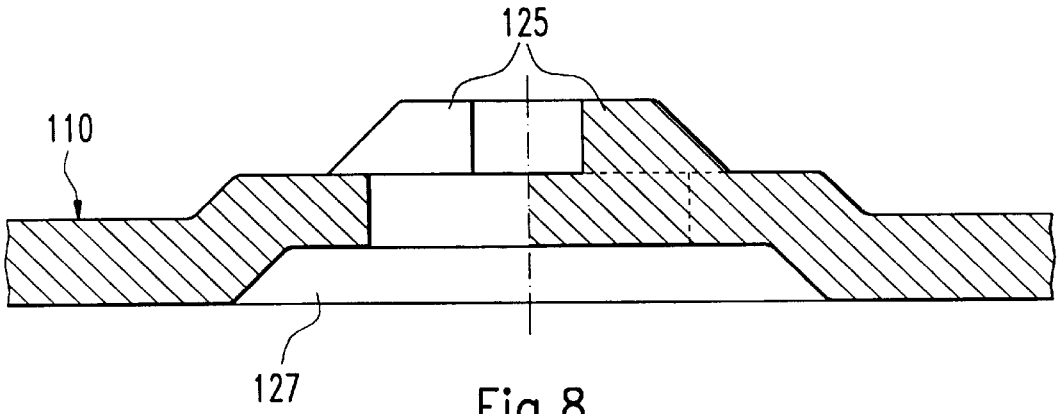
FIG. 8 is a view in cross-section through a through opening in an outer plate.

Referring firstly to FIG. 1, diagrammatically shown therein in an exploded view is a side edge assembly according to the invention for forming the lateral termination or closure of a stepped cooling grate in which, in the illustrated construction, each two fixed steps as indicated by 2 and 4 are followed by a respective movable step as indicated by 6. The movement of the movable step 6 is indicated by the double-headed arrow in FIG. 1.

The side edge assembly of which a portion is shown in FIG. 1 includes a first layer or aligned array, which is remote from the cooling grate, of outer plates 8, 10 which are arranged in succession in the longitudinal direction of the cooling grate and thus also the side edge assembly and which meet at the joins 12 and 14 respectively, and a second layer or aligned array, which is towards the cooling grate, of inner plates 16, 18 which are arranged in succession in the longitudinal direction of the cooling grate and thus the side edge assembly and which meet at the joins 20 and 22. The inner plates 16, 18 are thus disposed between the outer plates 8, 10 and the cooling grate 2, 4 and 6. As can be seen from FIG. 1, the joins 12, 14 between the respective outer plates 8, 10 are displaced relative to the joins 20, 22 between the inner plates 16, 18 in the longitudinal direction of the side edge assembly; an inner plate 16 covers over a respective join 12 while an inner plate 18 covers over a respective join 14 between the outer plates.

The inner plates 16, 18 are applied to and fixedly connected to the outer plates 8, 10. For the purposes of making a strong connection, provided in the upper region of each of the outer plates 8, 10 and the inner plates 16, 18 are respective through openings 24 and 26 which receive specific connecting pins or bolts which are described in greater detail hereinafter. In addition, in their lower wall region, the outer plates 8, 10 have through bores which each serve to receive a fixing pin or bolt (not shown) for fixing the respective outer plates to a suitable support structure (not shown).

As FIG. 1 also shows the outer plates 8, 10 project downwardly at least in a region-wise manner beyond the inner plates 16, 18. The projecting regions as indicated at 30 and 32 of the outer plate 8 and the projecting region as indicated at 34 of the outer plate 10 project inwardly substantially by the thickness of the inner plates 16, 18 and form respective shoulders for supporting the inner plates thereon.

As FIG. 1 further shows, the fixed steps 2 and 4 respectively bear against inner surfaces of the projecting regions 32, 34 and 34, 30 respectively of the outer plates 8, 10. In contrast, in the region of the movable step 6, the outer plates do not have a projecting region; here the inner plate 16 is extended downwardly to such an extent that the movable step 6 bears against the inner plate 16.

Different materials may be used for the outer plates 8, 10 on the one hand and the inner plates 16, 18 on the other hand. Preferably, the material selected for the outer plates 8, 10 is adopted on the basis of static aspects while the material selected for the inner plates is adopted in consideration of particular resistance to wear. In the region of the fixed steps 2, 4 the inner plates are required predominantly to withstand the wear caused by the hot abrasive material to be cooled while in the region of the movable step 6 account is additionally to be taken of wear caused by the friction between the step 6 and the inner plate 16.

Provided in the region of the movable step 6 of the cooling grate, on the inner plate 16, is a web portion 36 which projects from the inner plate 16 at a right angle and which extends in the direction of movement of the step 6, for covering the motion gap between the step 6 and the inner plate 16.

For structural reasons, the outer plates 8 and 10 are of different lengths. As FIG. 1 clearly shows however the common pitch length of the outer plates 8 and 10 is equal to the common pitch length of two inner plates 16 and 18 so that the pattern constituted by the mutual arrangement of outer plates and inner plates is regularly repeated along the length of the side edge assembly.

Figure 2:
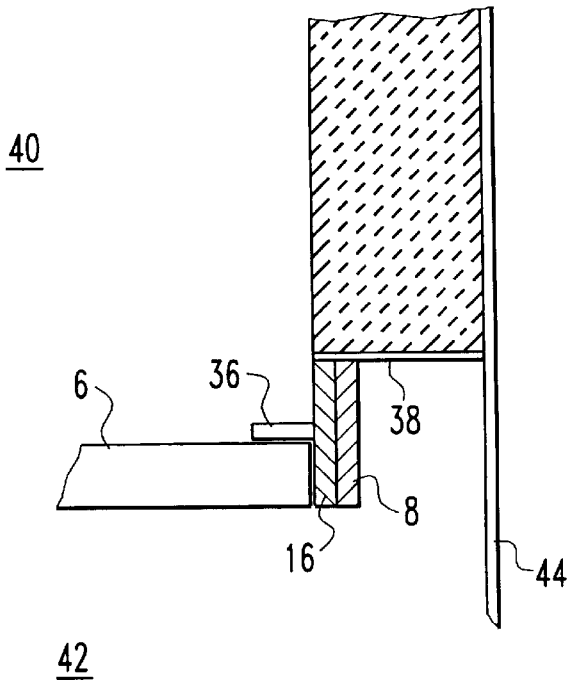
FIG. 2 is a view in cross-section through a side edge assembly in the region of a movable step.

Reference is now made to FIG. 2 showing a view in section through the outer plate 8 and the inner plate 16 along section line II—II in FIG. 1. In this region the outer plate 8 does not have an inwardly projecting portion so that the two plates terminate flush with each other at top and bottom. A web portion 36 projects inwardly from the inner plate 16 at a right angle, to cover a motion gap between the movable step 6 of the cooling grate and the inner plate 16. The outer plate 8 and the inner plate 16 bear sealingly at their top against a cover plate 38 above which is disposed the inside wall, made from refractory material, of a recuperator chamber 40. Beneath the grate defined by the movable step 6 is a cooling air chamber 42 which is closed outwardly by a side wall 44.

It will be noted that the above-described arrangement is diagrammatic and can be varied in terms of its specific design configuration.

Figure 3A:
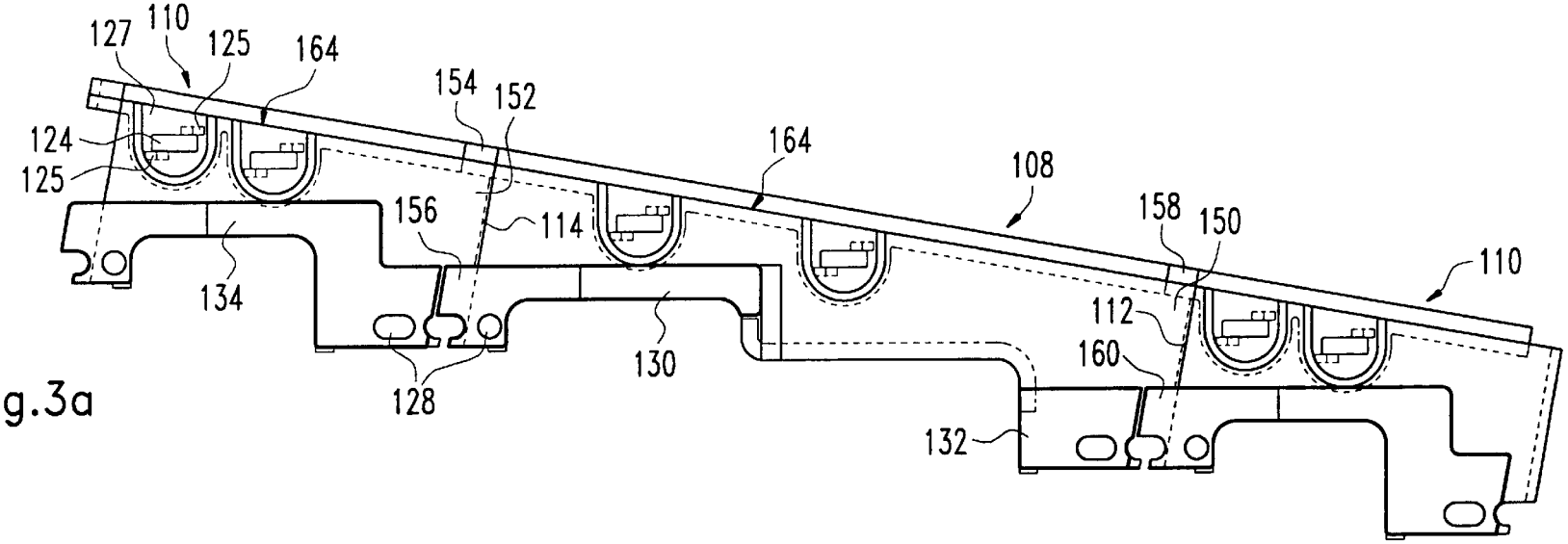
FIG. 3*a* is a view of a plurality of assembled outer plates.
Figure 3B:
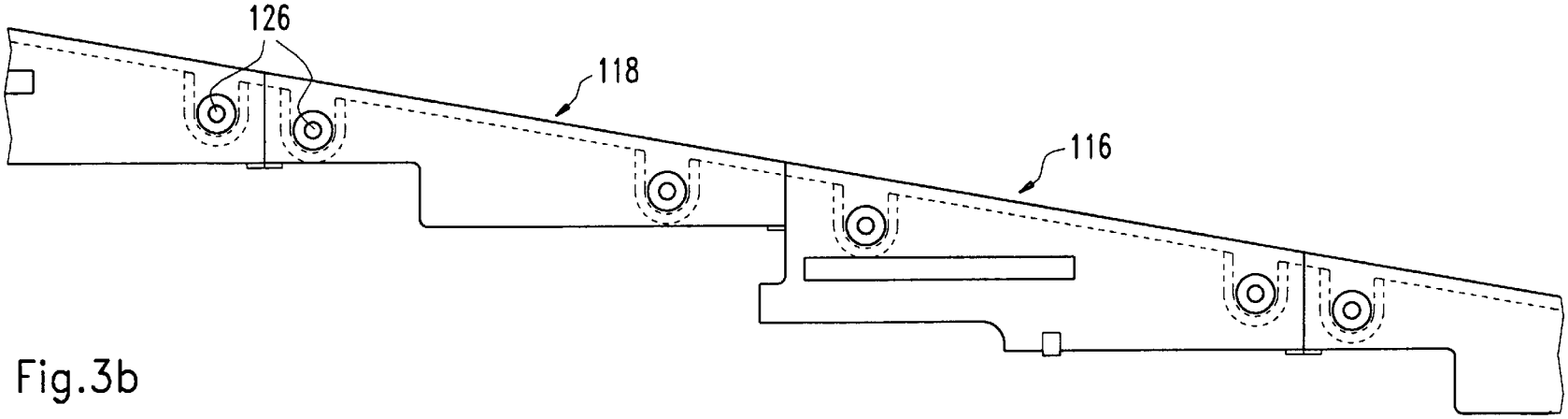
FIG. 3*b* is a view of a plurality of inner plates which are fitted together.

Referring now to FIGS. 3*a* and 3*b*, shown therein are specific design configurations of the outer plates and inner plates diagrammatically illustrated in FIG. 1. In this respect, the same components are denoted in FIGS. 3*a* and 3*b* by the references used in FIG. 1, but increased by 100.

Figure 7:
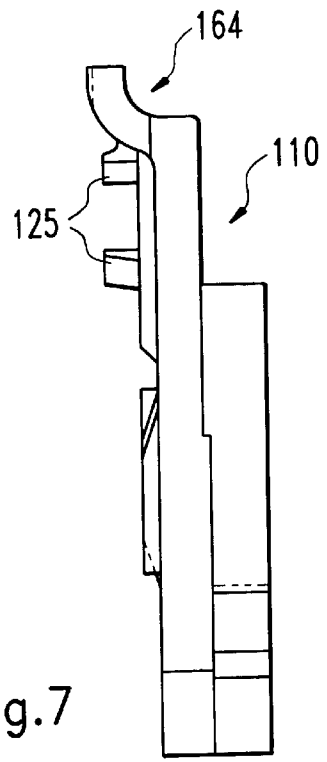
FIG. 7 is an end view of the outer plate shown in FIG. 6.
Figure 6:
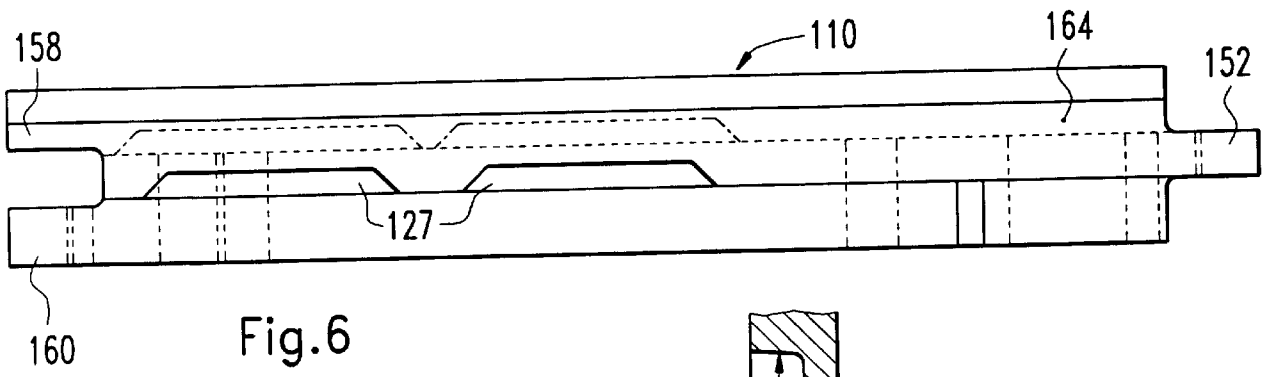
FIG. 6 is a plan view of one of the outer plates.

FIG. 3*a* shows a succession of a short outer plate 110, a long outer plate 108 and a short outer plate 110. FIG. 6 also shows a plan view of a short outer plate 110 and FIG. 7 shows an end view of the short outer plate 110.

Figure 4:
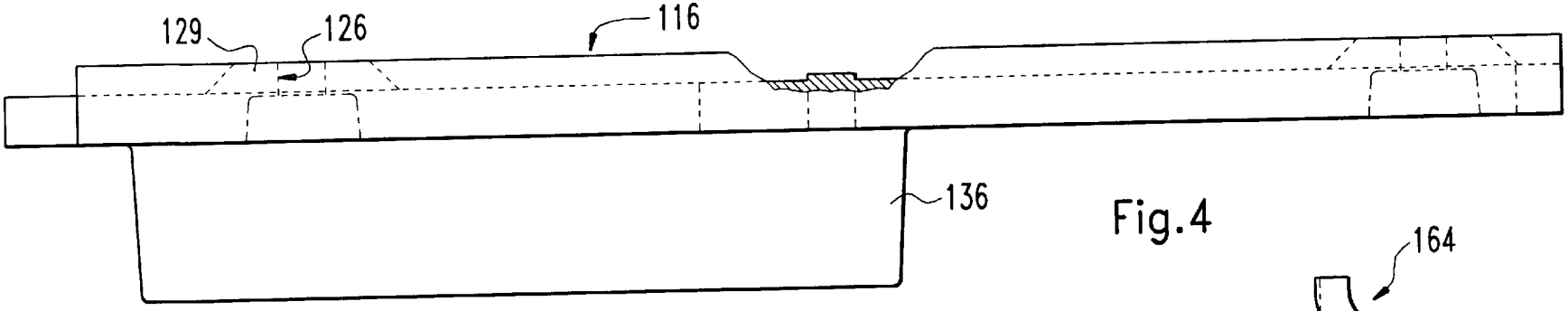
FIG. 4 is a plan view of one of the inner plates.
Figure 5:
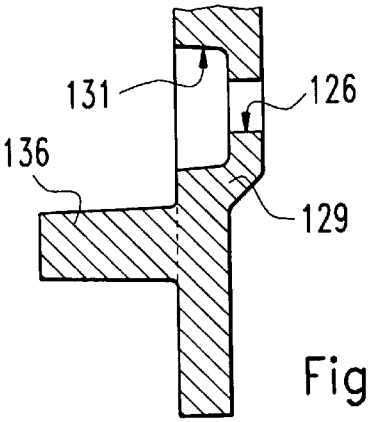
FIG. 5 is a view in cross-section through part of the inner plate shown in FIG. 4.

FIG. 3*b* shows an alternate succession of inner plates 116 and 118. FIG. 4 shows a plan view of the inner plate 116 while FIG. 5 is a view in cross-section of part thereof.

As can be seen from FIG. 3*a*, the joins between the outer plates 108 and 110 are each in the form of a respective groove-and-tongue connection. Provided at the right-hand end of each of the outer plates 108 and 110 are tongues as indicated at 150 and 152 respectively, which are at least partially embraced by shaped lug portions 154, 156 and 158, 160 respectively provided at the left-hand ends of the respective outer plates 108 and 110. This configuration can also be seen in FIG. 6 with a tongue 152 at the right-hand end of the plate 110 therein and with the shaped lugs 158 and 160 at the left-hand end of the plate 110.

At their upper edge the outer plates 108 and 110 which are flush with each other form a recess 164 into which a sealing means, for example a cord-type seal can be fitted. The recess 164 is supplemented by inner plates which are fitted to the outer plates.

As FIG. 3*a* further shows, the through openings 124 in the outer plates 108 and 110 respectively are each in the form of respective slots through which a connecting pin provided with a hammer head can be fitted. By rotating the connecting pin through 90°, the hammer head abuts against abutments 125 on the outside of the outer plates, and is rotationally fixed in that way. As FIG. 6 in particular shows, the through openings 124 in the short outer plates 110 (like the through openings in the long outer plates 108) are each surrounded by a respective centering recess or depression 127, the function and purpose of which will be described in greater detail hereinafter.

Figure 9:
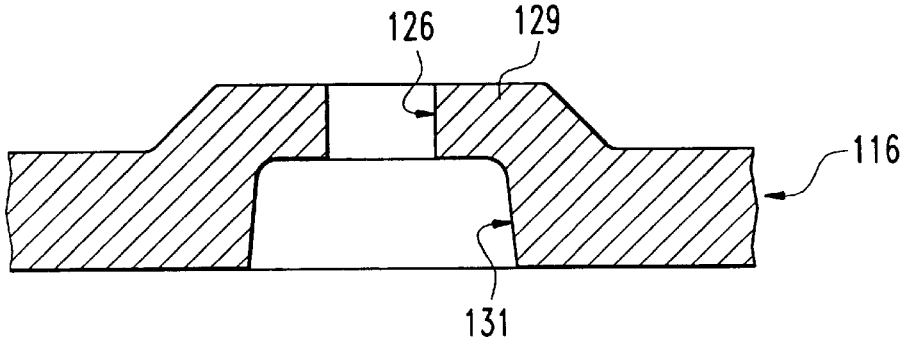
FIG. 9 is a view in cross-section through a through opening in an inner plate.

For fitting purposes the inner plates 116 and 118 shown in FIG. 3*b* are displaced upwardly relative to the outer plates to such a degree that associated through openings 126 in the inner plates are aligned with respective through openings 124 in the outer plates. As can be seen in particular from FIGS. 4 and 9 the through openings 126 in the inner plate 116 (and likewise those in the inner plate 118) are surrounded at their outside by a centering thickened portion 129 which centeringly co-operates with a complementary centering recess or depression 127 on the inside of an outer plate. The inside of the through opening 126 is surrounded by a recess or depression 131 for receiving a nut, in flush relationship with the inside of the inner plate.

For fitting the outer wall assembly, firstly the outer plates 108, 110 are assembled and connected by way of their through bores 128 to a suitable support structure. The inner plates are then fitted to the outer plates, in which operation the inner plates can be fitted on to the shoulders defined by the projecting regions 130, 132 and 134. The centering recesses 127 on the outer plates on the one hand and the centering thickened portions 129 on the inner plates on the other hand make it easier for the through openings to be aligned in correct positional relationship. In that case the connecting pins or bolts are preferably already introduced into the through openings 126 and are secured by a suitable nut. When the inner plates are fitted on to the outer plates the hammer heads of the connecting pins are passed through the associated through openings 124 and turned until they bear against the abutments 125. The appropriate nut can now be tightened.

The mutually displaced arrangement of the joins of the inner plates and the outer plates, and the fact that the inner surfaces of the outer plates and the outer surfaces of the inner plates are in complementary contact with each other provide an extremely effective sealing action so that the side edge assembly as such is at least substantially gas-tight. A further advantage of the above-described arrangement is that fitting and removal of the inner plates, for example for the purposes of replacing worn inner plates, can be effected from the top of the grate, without involving more extensive dismantling of parts of the grate.

The foregoing description of preferred embodiments of the invention provided a description of a side edge assembly for a cooling grate in which a movable step follows each two fixed steps. That structural pattern results in the particular distribution as described above of the outer and inner plates respectively. It will be appreciated that it is also possible to envisage other structural configurations, for example in such a fashion that a fixed step and a movable step follow each other, in which case the outer plates and the inner plates are to be structurally suitably adapted.

It will be appreciated from the foregoing description that the fact that the side edge assembly is divided into individual plates permits easier assembly thereof on site. The displaced joins between the plates ensure a good sealing effect in relation to leakage to the exterior of material to be cooled, and also in relation to the improper penetration of infiltration air into the grate. The configuration with the inner and outer plates permits the inner plates to be in the form of wearing components which can be replaced without substantial dismantling of other components of the side edge assembly.

It will be appreciated that the foregoing structures in accordance with the principles of the present invention have been set forth solely by way of example and illustration of the invention and that various modifications and alterations may be made therein without thereby departing from the spirit and scope of the invention.

What is claimed is:

1. A side edge assembly for a cooling grate including a first array of outer plates arranged in succession in the longitudinal direction of the cooling grate and a second array of inner plates which are arranged in succession in the longitudinal direction of the cooling grate, the inner plates being disposed between the outer plates and the cooling grate, the outer plates of the first array meeting at joins therebetwen and the inner plates of the second array meeting at joins therebetween, and in the assembled condition the joins of the outer plates and the joins of the inner plates being displaced relative to each other in said longitudinal direction.

2. A side edge assembly as set forth in claim 1 wherein the outer plates and the inner plates which are in mutually overlapping relationship are connected together.

3. A side edge assembly as set forth in claim 1 wherein the outer plates have means for connection to a support structure for carrying the side edge assembly.

4. A side edge assembly as set forth in claim 1 wherein the inner plates have means for connection to a support structure for carrying the side edge assembly.

5. A side edge assembly as set forth in claim 1, in particular for a pusher grate with reciprocable rows of grate portions, wherein the inner plates comprise a wear-resistant material.

6. A side edge assembly as set forth in claim 1 wherein in the assembled condition the outer plates and the inner plates are substantially flush with each other at their top edges and form a recess means for receiving a sealing means.

7. A side edge assembly as set forth in claim 1 wherein the joins of the outer plates are each of a groove-and-tongue connection type.

8. A side edge assembly as set forth in claim 1 wherein the joins of the inner plates are each of a groove-and-tongue connection type.

9. A side edge assembly as set forth in claim 1 wherein the inner surfaces of the outer plates and the outer surfaces of the inner plates have a mutually complementary surface structure which ensures contact thereof over a large area.

10. A side edge assembly as set forth in claim 1 wherein the outer plates project downwardly at least in a region-wise manner beyond the inner plates, and wherein the projecting regions project inwardly substantially by the thickness of the inner plates and form a shoulder for supporting the inner plates.

11. A side edge assembly as set forth in claim 1 wherein the common pitch length of a predetermined number of inner plates is substantially equal to the common pitch length of the same number of outer plates.

12. A side edge assembly as set forth in claim 1 wherein the outer plates are provided with through openings for bayonet-like connecting pins to be fitted thereto by passing through said openings.

13. A side edge assembly as set forth in claim 1, in particular for a pusher grate comprising reciprocable rows of grate portions, including at least in the region of a reciprocable row of grate portions at the inside of the inner plate a web portion which projects substantially at a right angle from said inside of said inner plate and which extends in the direction of movement of said row of grate portions, for covering the motion gap between the row of grate portions and the side edge assembly.

14. An outer plate for a side edge assembly comprising first and second aligned arrays of plates as set forth in claim 1 comprising a plurality of outer plates arranged in succession in the longitudinal direction of the side edge assembly and a plurality of inner plates arranged in succession in said longitudinal direction and bearing against the outer plates, the outer plate having a first edge and a second edge and a tongue means at the first edge and a groove means at the second edge for a groove-and-tongue connection to a respective outer plate arranged adjacent same, the outer plate further including an upper edge having an outwardly directed cranked portion for receiving a sealing means, and a lower region having an inwardly projecting thickened portion which forms an inner shoulder.

15. An outer plate as set forth in claim 14 including in its upper wall region at least one through opening for receiving a connecting pin for making a connection to an inner plate, and in its lower wall region formed by said thickened portion at least one through bore for receiving a fixing pin for fixing to a support structure.

16. An outer plate as set forth in claim 15 wherein said through opening is in the form of a slot for the passage therethrough of a bayonet head of the connecting pin, and including abutment means for rotationally arresting a bayonet head at the outside of the through opening.

17. An outer plate as set forth in claim 15 including a substantially conical centering recess surrounding the inside of the through opening and adapted to co-operate with a complementary centering thickened portion on the outside of an inner plate.

18. An inner plate for a side edge assembly comprising first and second aligned arrays of plates comprising a plurality of outer plates arranged in succession in the longitudinal direction of the side edge assembly and a plurality of inner plates arranged in succession in said longitudinal direction and bearing against the outer plates, including in an upper wall region thereof at least one through opening for receiving a connecting pin for connection to an outer plate.

19. An inner plate as set forth in claim 18 including a substantially conical centering thickened portion surround the outside of the through opening and adapted to co-operate with a complementary centering recess at the inside of an outer plate, and including a recess surrounding the inside of the through opening for receiving a bolt nut in flush relationship with the inside of the inner plate.

20. An inner plate as set forth in claim 18 including on the inside of an inner plate a web portion which projects therefrom substantially at a right angle thereto and which is oriented in the longitudinal direction of the inner plate.

21. A side edge assembly as set forth in claim 1 for a cooling grate alternately comprising first and second fixed rows of grate portions and a movable row of grate portions, wherein the movable row of grate portions bears directly against inner plates and the first and second fixed rows of grate portions bear against lower edge projection portions of the outer plates.

* * * * *